US006843263B2

(12) United States Patent
Kuo et al.

(10) Patent No.: US 6,843,263 B2
(45) Date of Patent: Jan. 18, 2005

(54) PARTIALLY CLOSED MICROFLUIDIC SYSTEM AND MICROFLUIDIC DRIVING METHOD

(75) Inventors: Yuan-Fong Kuo, Hsinchu (TW); Nan-Kuang Yao, Taoyuan (TW); Jhy-Wen Wu, Hsinchu (TW); Tim Shia, Taichung (TW); Shaw-Hwa Parng, Miaoli (TW)

(73) Assignee: Industrial Technology Research Institute, Hsinchu (TW)

( * ) Notice: Subject to any disclaimer, the term of this patent is extended or adjusted under 35 U.S.C. 154(b) by 174 days.

(21) Appl. No.: 10/177,122

(22) Filed: Jun. 24, 2002

(65) Prior Publication Data

US 2003/0233827 A1 Dec. 25, 2003

(51) Int. Cl.[7] ..... F17D 1/18; F15C 1/04

(52) U.S. Cl. ..... 137/14; 137/831; 137/833; 251/368

(58) Field of Search ..... 137/833, 829, 137/830, 831, 14; 251/368, 61.1

(56) References Cited

U.S. PATENT DOCUMENTS 3,547,139 A * 12/1970 Berkum ..... 137/819
3,747,628 A * 7/1973 Holster et al. ..... 137/269
4,449,426 A * 5/1984 Younger ..... 477/127
4,943,032 A * 7/1990 Zdeblick ..... 251/11
6,068,751 A * 5/2000 Neukermans ..... 204/601
6,521,188 B1 * 2/2003 Webster ..... 422/100
6,581,640 B1 * 6/2003 Barron ..... 137/833

* cited by examiner

*Primary Examiner*—A. Michael Chambers
(74) *Attorney, Agent, or Firm*—Birch, Stewart, Kolasch & Birch, LLP

(57) ABSTRACT

This specification disclosed a partially closed microfluidic system and a fluid driving method. The microfluidic system is comprised of a substrate with microfluidic elements and a thin film. A feature of this structure is that the thin film is elastic and deformable. It has a single opening corresponding to a vent hole on the substrate, thus forming a partially closed microfluidic system. The substrate is designed to have several positions for micro fluid elements and deformable chambers and uses micro channels to form a complete network. Since the thin film is elastic and deformable, one is able to impose a pressure on the thin film above the deformable chambers in this partially closed microfluidic system to drive the fluid into motion. Once the pressure is released, the fluid flows back to its original configuration.

30 Claims, 9 Drawing Sheets

PARTIALLY CLOSED MICROFLUIDIC SYSTEM AND MICROFLUIDIC DRIVING METHOD

BACKGROUND OF THE INVENTION

1. Field of Invention

The invention pertains to a microfluidic system on chips and, in particular, to a partially closed microfluidic system in which the fluid makes a reciprocal motion and a corresponding fluid driving method.

2. Related Art

Pump systems are commonly used in driving fluid. In addition to the uses of external pumps, chips also employ internal driving methods. These built-in driving means can be classified as mechanic micropumps and non-mechanic micropumps. In particular, the mechanic micropump technique includes the reciprocating-diaphragm and peristaltic types.

Most existing micropumps belong to the reciprocating-diaphragm type. This type of micropumps generally has a structure comprised of a pump body, an actuator, and a check valve. Commonly used actuators are piezoelectric, electrostatic, and thermopneumatic. Examples of non-mechanic micropumps include bubble pumps, diffuser pumps, electrohydrodynamic pumps (EHD), injection type EHD pumps, non-injection type EHD pumps, electroosmosis/electrophoretic pumps, ultrasonic pumps, thermocapillary pumps, pneumatic pumps, and vacuum pumps.

Generally speaking, mechanic pumps only provide one-way driving and, therefore, often cannot satisfy the need for two-way driving. Non-mechanic pumps have different limitations, depending upon different designs. For example, the driving effect of the electroosmosis pump is only observable on a capillary with a diameter smaller than 50 $\mu$m. Furthermore, these on-chip pumps have to be manufactured using a MEMS (Micro-Electro-Mechanic System) procedure. Since the cost of this kind of manufacturing process is higher, it is not ideal to be implemented on dispensable chips with limited functions.

As the current medical technology has more urgent needs in chip detection, dispensable chips have become a mainstream under development. In view of the fact that current pump technologies cannot satisfy the needs, it is therefore desirable to find other simple driving method.

SUMMARY OF THE INVENTION

The invention provides a partially closed micro fluid system and a fluid driving method to achieve the objective of easy manufacturing, low cost and dispensability.

To achieve the above objectives, the disclosed partially closed fluid system is comprised of a substrate with some microfluidic device and an elastic, deformable thin film. The fluid is filled inside the device. One feature of the invention is on the design of the substrate. The substrate has more than one microfluidic element, more than one deformable chamber, a vent hole, and a plurality of micro channels. The micro channels are used to connect the microfluidic elements, deformable chambers, and the vent hole to form a connected network for the fluid. The thin film is attached onto the substrate and has an opening for the vent hole, forming a partially closed loop.

Through such a simple design, the invention can use a simple method to drive the fluid inside the substrate by imposing a pressure on the thin film above the deformable chambers. When a pressure is imposed, the fluid inside the deformable chambers is pushed to flow, with the pressure released through the vent hole on another end. Once the pressure is released, the fluid flows back due to the elastic restoration of the thin film.

Furthermore, the invention provides a partially closed microfluidic system, which is designed with several sets of microfluidic channels on its substrate that share a single vent hole and a micro fluid element. In this way, different channels can be filled with different kinds of fluid. Finally, one can also mix individual fluids in the shared micro fluid element.

The embodiment with more than one deformable chamber can readily conquer the distance limitation in pushing the fluid. The deformable chambers can be connected in series or parallel in order to extend the fluid flowing distance.

BRIEF DESCRIPTION OF THE DRAWINGS

The invention will become more fully understood from the detailed description given hereinbelow illustration only, and thus are not limitative of the present invention, and wherein.

DETAILED DESCRIPTION OF THE INVENTION

The invention provides one or several deformable chambers inside a micro fluid system so that the fluid can be driven to flow by imposing a pressure on the deformable chambers. That is, an elastic deformable thin film is attached on the substrate of a micro fluid chip to form a partially closed micro fluid system. The so-called partially closed micro fluid chip does not have any hole or channel connecting to its ambient space except for a vent hole when in operation.

In addition to necessary microfluidic elements, the chip is also provided with one or several deformable chambers that are connected in series or independent of one another. The deformable chambers are connected to the microfluidic elements on the chip through micro channels. The deformable chambers and the microfluidic elements are connected by micro channels, forming the microfluidic system for the micro fluid. A fine-tunable actuator is provided at each deformable chamber. The microfluidic movement on the chip is made possible by having the actuator impose a pressure on the thin film. When the actuator is functioning, the volume of the deformable chamber changes, generating a positive pressure to push the micro fluid. After the actuator releases the thin film, the elasticity of the thin film produces a negative pressure inside the deformable chamber so that the micro fluid makes a reverse directional flow.

Figure 1:
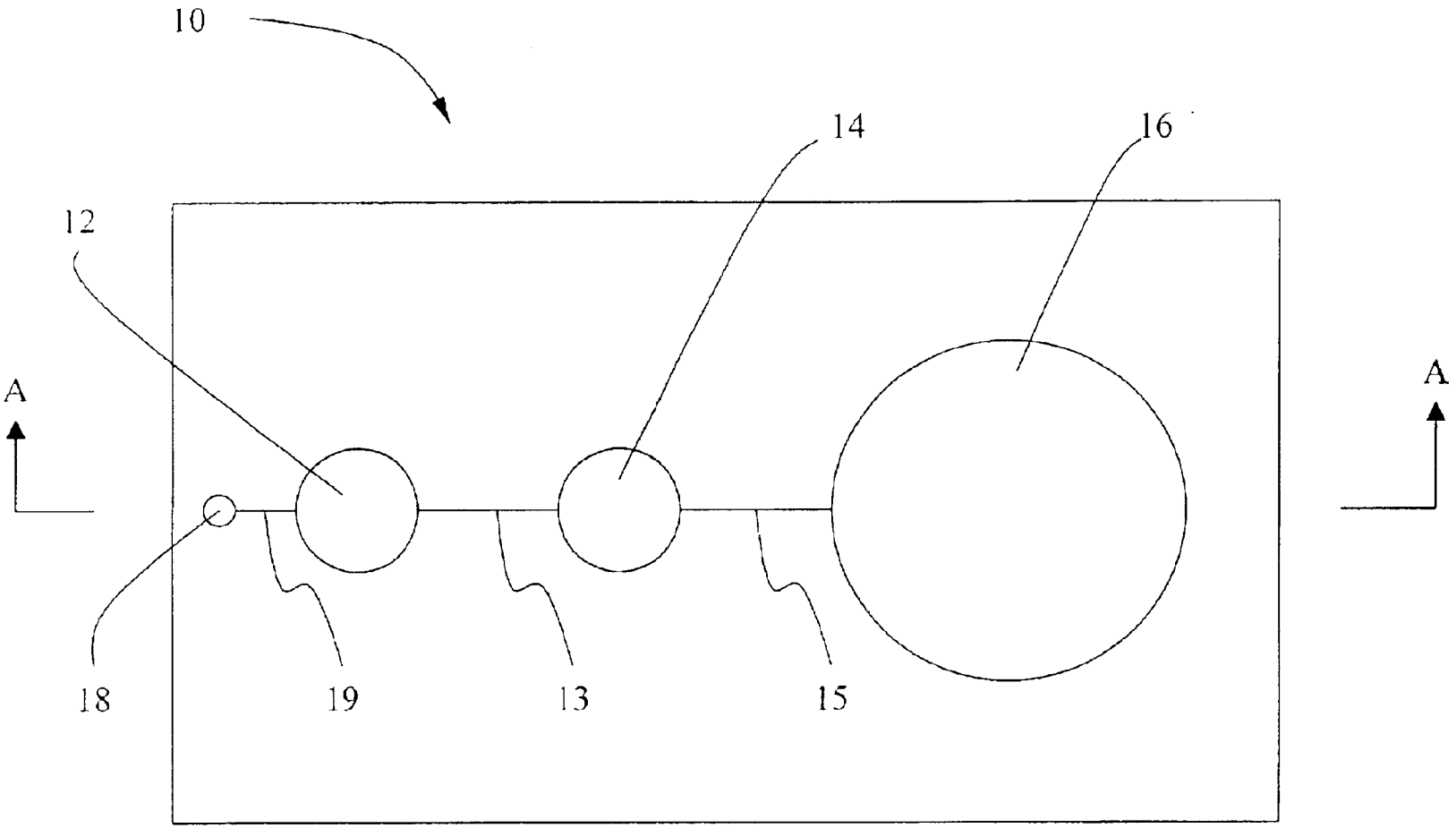
FIG. 1 is a schematic view of the layout of the disclosed microfluidic chip.

FIG. 1 is a schematic view of the layout of the disclosed microfluidic chip 10. There are two different micro fluid reaction areas on the microfluidic chip 10: one being a vent hole and the other being a deformable chamber. These three parts are connected through micro channels. As shown in the drawing, the microfluidic chip 10 is comprised of a deformable chamber 16, a vent hole 18, a first microfluidic element 12, and a second microfluidic element 14. The first and second microfluidic elements 12, 14 can be any kind of microfluidic elements, such as heating chambers, reaction chambers, and mixers. These parts are connected by first, second and third micro channels 13, 15, 19.

Figure 2:
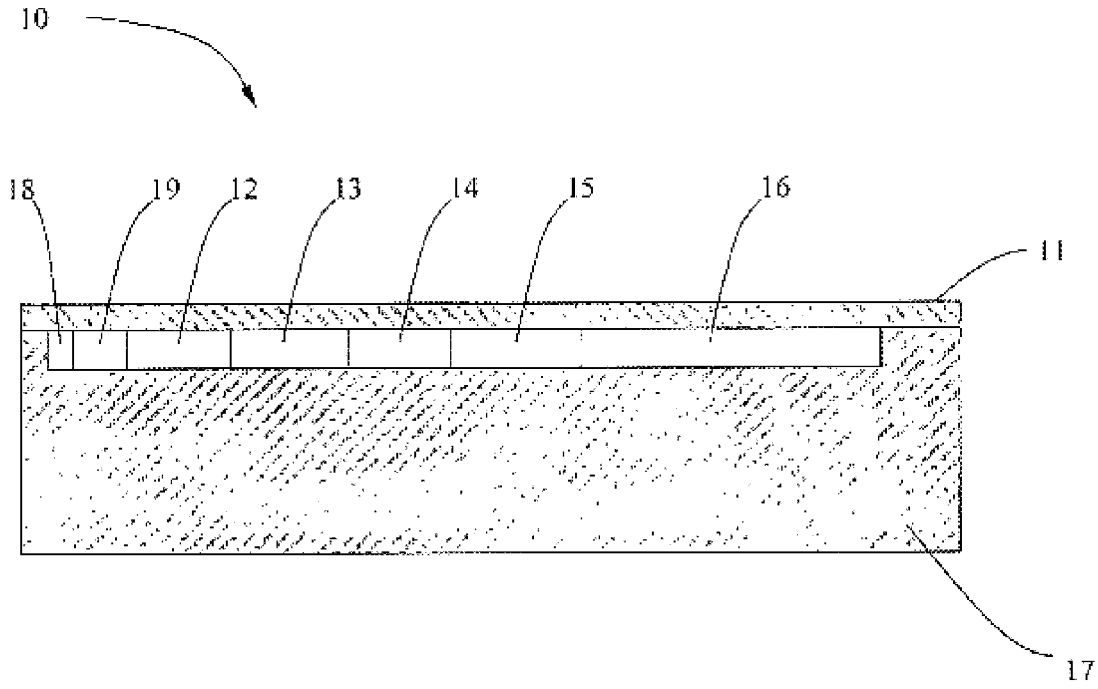
FIG. 2 is a cross-sectional view of FIG. 1.

With reference to FIG. 2, which is a cross-sectional view of FIG. 1, the whole microfluidic chip 10 is comprised of a chip substrate 17 and an elastic, deformable thin film 11. The substrate 17 accommodates the channels of the microfluidic elements. The substrate 17 can be made of silicon-based materials, such as glass, quartz, silicon, and polysilicon, or polymeric materials, i.e. plastics, such as polymethylmethacrylate (PMMA), polycarbonate, polytetrafluoroethylene (TEFLON™), polyvinyl-chloride (PVC), polydimethylsiloxane (PDMS), polysulfone, SU-8 and other similar materials.

The elastic, deformable thin film 11 is used for packing the chip. The thin film material can be selected from daily used tapes, or thin films similar to AMC D291 polyester films.

The fabrication of microfluidic elements and micro channels varies for different materials. Such manufacturing technologies include photolithography, MEMS, laser ablation, air abrasion, injection molding, embossing or stamping, polymerizing the polymeric precursor material in the mold, etc.

The combination of the thin film 11 and the substrate 17 relies upon the sticky side of the thin film 11. Using a thin film 11 with a sticky side allows the chip packaging to be performed under room temperature. This method is not only easy in operation but also does not need to pre-fill an agent. The agent itself would not be exposed to high temperatures either.

Moreover, using thin film materials makes the agent filling much easier. For example, the agent loading can be accomplished using an injector. One only needs to fill the injector with the agent and then injects the agent to desired places. Once the injection is down, one simply covers the injection hole by a small piece of thin film.

The power source of pushing the micro fluid is from deforming the deformable chamber by an external force. This produces a positive pressure inside the deformable chamber to push the micro fluid. The transmission of the pressure can be achieved by air or by filling fluid, such as oil to form an hydraulic system, inside the deformable chamber. Using air as the pressure transmit media may result in a slower response in the microfluidic motion to the external force because of the compressibility of air. The situation becomes more serious if there are a lot of places filled with air. Consequently, filling the deformable chamber with liquid can improve the response of the micro fluid.

In addition to the compressibility, air also has a superior permeability than liquid. If the thin film has a good permeability or is not perfectly packed, it is likely to have air leakage, resulting in unsatisfactory driving effects. Of course, whether the deformable chamber should be filled with liquid depends upon the design and usage. As long as the problems due to compressibility and permeability can be avoided or do not affect too much, using air as the medium would be the simplest method.

The mechanism for pushing and deforming the thin film can be an actuator that makes a linear motion, an eccentric wheel or cam that makes a curved motion, or a pneumatic or thermodynamic drive.

Figure 3A:
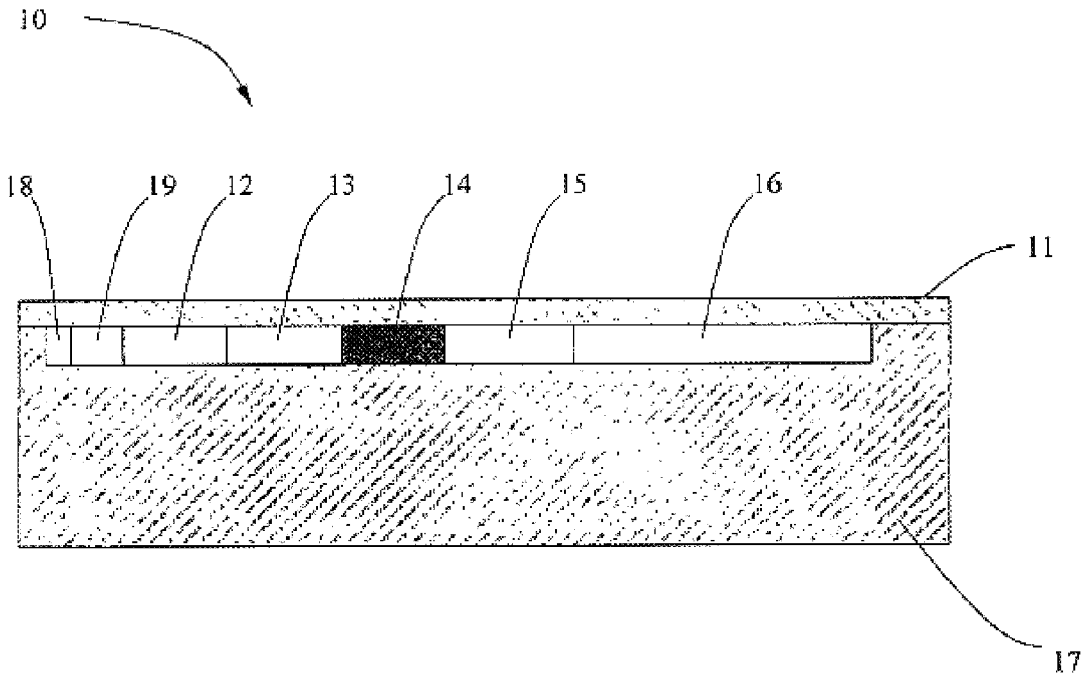
FIGS. 3A through 3C schematically show the micro fluid motion inside the chip by deforming the deformable chamber.
Figure 3B:
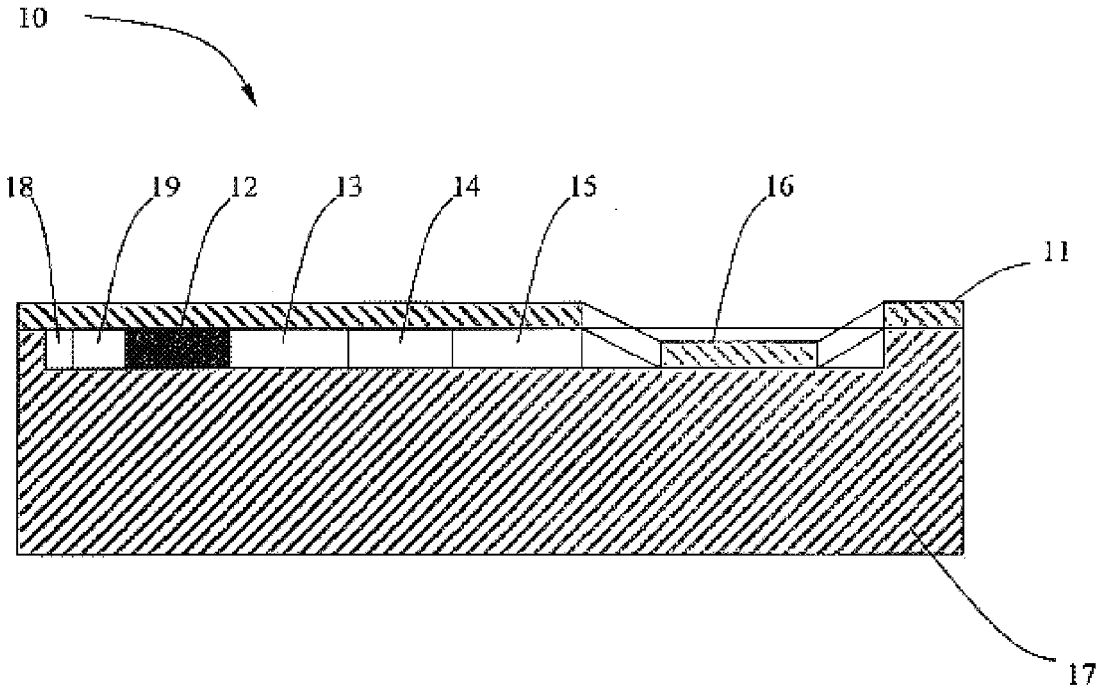
Figure 3C:
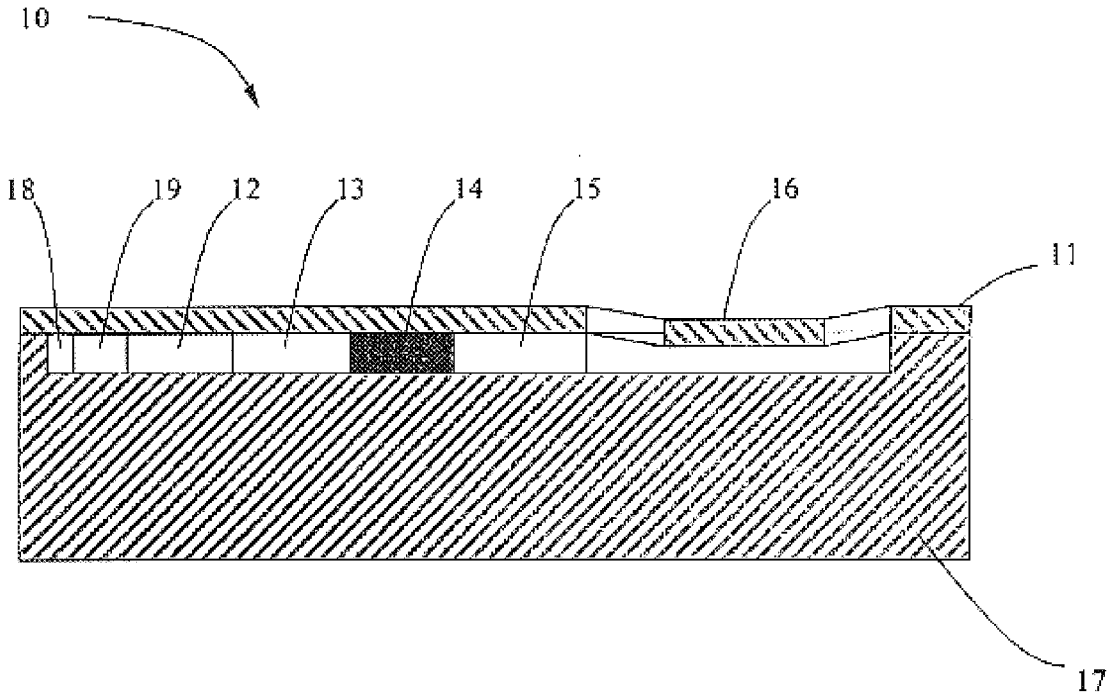

FIGS. 3A through 3C show how the invention deforms the deformable chamber 16 to make the micro fluid to make reciprocal motion inside the micro fluid chip 10. The micro fluid on the microfluidic chip 10 flows from the second microfluidic element 14 to the first microfluidic element 12. After the reaction is completed, the micro fluid is sent back to the second micro fluid element 14. Therefore, the reaction agent starts at the micro fluid element 14 and is sent to the first micro fluid element 12 (FIG. 3A). When depressing the deformable chamber 16, the micro fluid inside the second microfluidic element 14 under the positive pressure from the deformable chamber 16 flows the first microfluidic element 12 (FIG. 3B). After the reaction is completed, the pressure on the deformable chamber is removed. Due to the elasticity of the thin film 11, the pressure inside the deformable chamber 16 is lower than the atmospheric pressure and the micro fluid on the microfluidic chip 10 flows back to the second micro fluid element 14 under the pressure difference between the vent hole 18 and the deformable chamber 16 (FIG. 3C). This completes the need for reciprocating micro fluid flow on the chip.

When using the actuator to drive the deformable chamber, the diameter of the pressing part on the actuator has to be smaller than the internal diameter of the deformable chamber. If both diameters are roughly the same, then the driving effect may not be as good because of the strength of the thin film. On the other hand, the thin film may have large permanent deformation. After some experiments using micrometer caliper as the actuator, we find that it is preferable to use an actuator with a pressing part of 6 mm in diameter for a deformable chamber with a size of 10 mm. That is, it is easier to control the reciprocating motion of the micro fluid using this kind of ratio in sizes. Of course, the experimental result depends upon the thin film. In our experiments, the thin film is an AMC D291 polyester film In theory, the controllability of the disclosed driving method can be seen in the following equation. Suppose the deformable chamber is a circle with a radius r2, the pressing part of the actuator has a radius r1, and the depressing depth of the actuator is h, then the depressed volume is $$\Delta V = \frac{1}{3}\pi r_2^2 h_2 - \frac{1}{3}\pi r_1^2 h_1 \tag{1}$$

where h2 is the height of the circular cone with a radius r2, h1 is the height of the circular cone with a radius r1, and h=h2−h1. Furthermore, h2 and h1 has a fixed ratio relation and the above equation can be simplified to $$\Delta V = \frac{1}{3}\pi h(r_2^2 + r_2 r_1 + r_1^2) \tag{2}$$

From Eq. (2), one learns that the depressed volume change is proportional to the depressed depth. Due to the volume conservation, the micro fluid on the chip has the same "volume displacement". When displacing the fluid inside a section of the micro channel, if the cross section of the channel is uniform, then it is expected to have $$l = \frac{\Delta V}{A} = Const \times h \quad (3)$$

Eq. (3) depicts a linear relation. Therefore, this kind of driving method is easy in operation.

It is of great help for the disclosed invention to be able to compute the volume displacement. First, it is necessary to find out which elements are on the micro fluid chip and how much the agent or buffer is needed to be processed. Once the elements, micro channels, and the layout are decided, one can then compute the size of the deformable chamber.

Figure 4A:
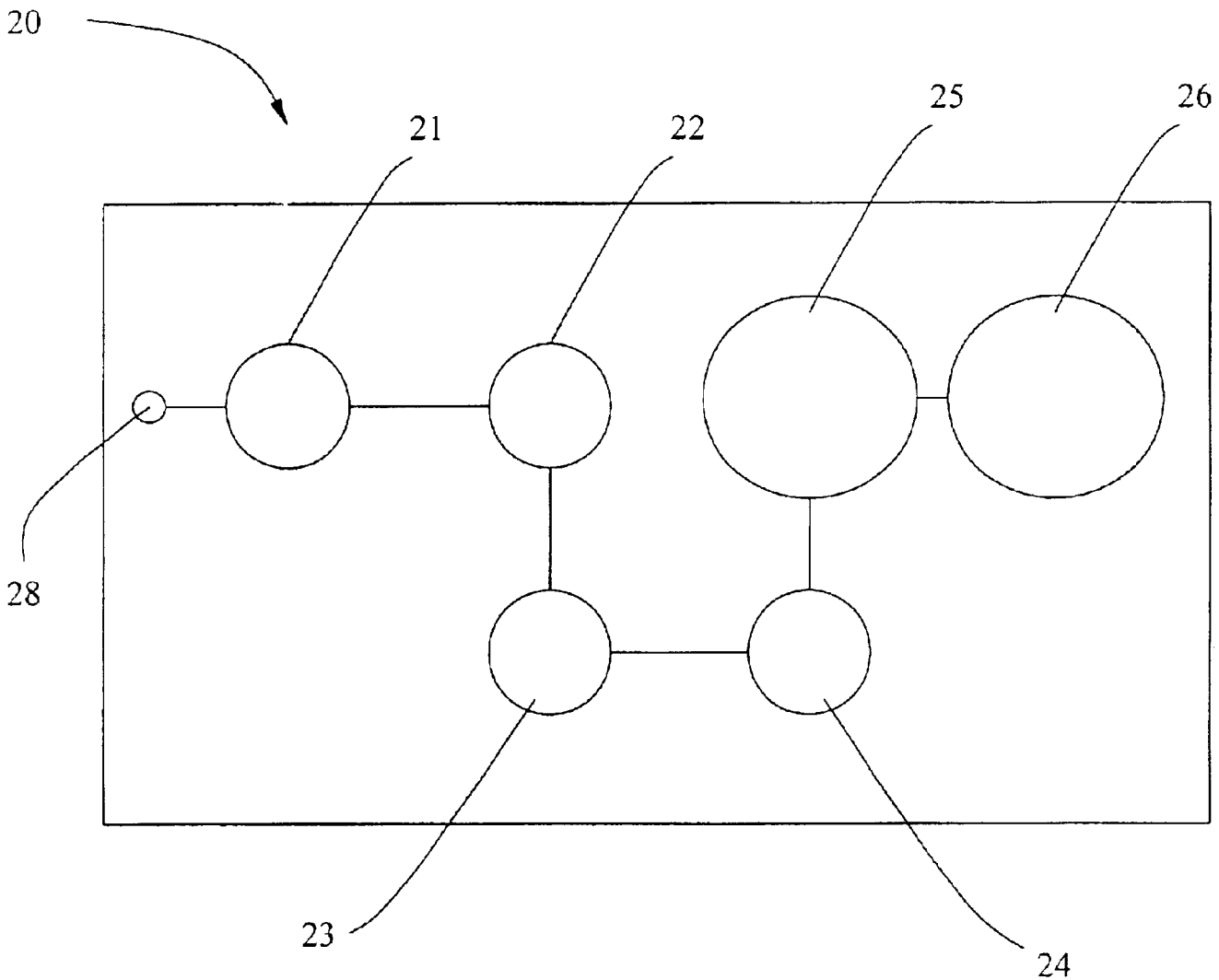
FIG. 4A is a schematic view of deformable chambers connected in series.
Figure 4B:
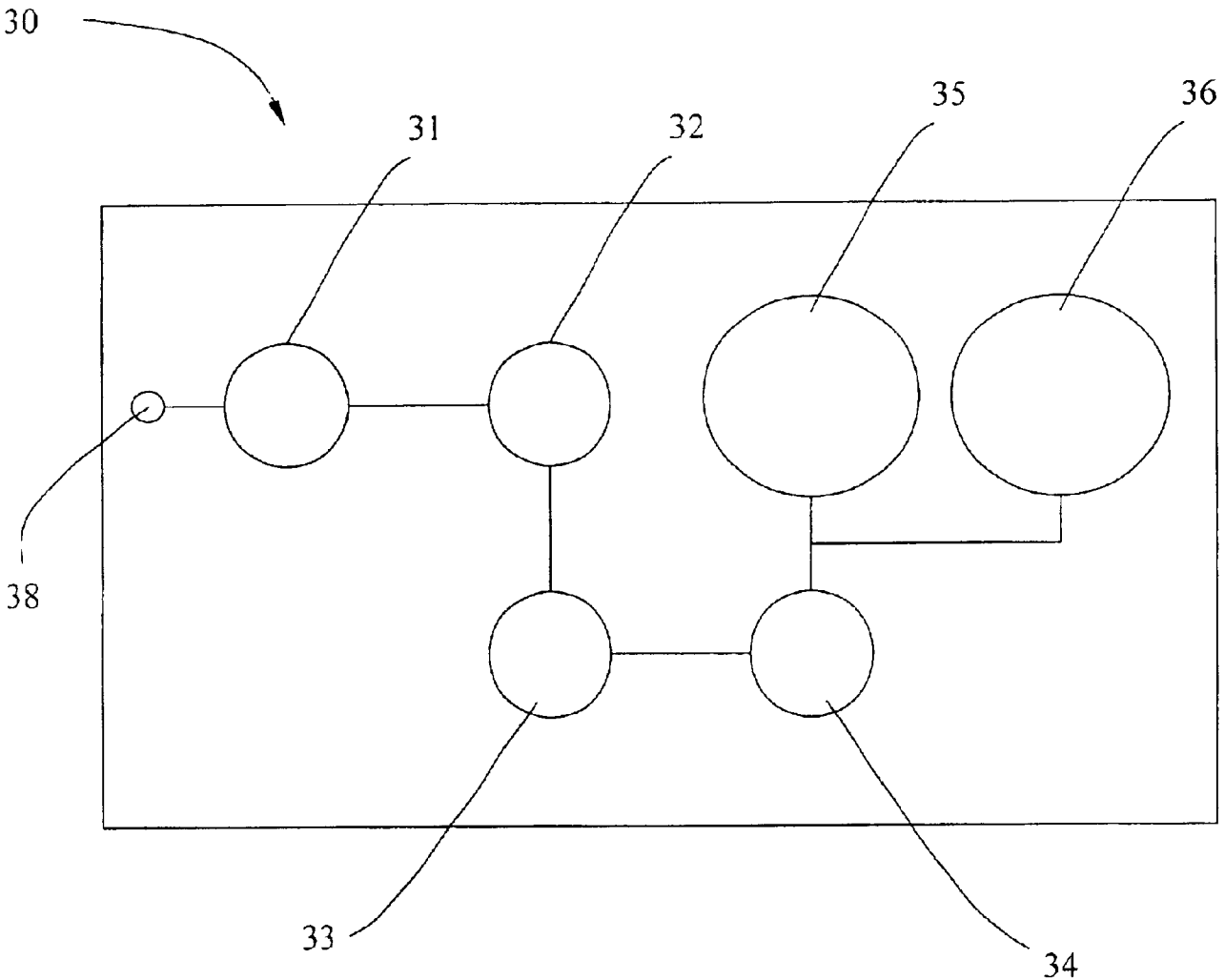
FIG. 4B is a schematic view of deformable chambers connected in parallel.

Nonetheless, the disclosed driving method still has its limitation in the driving distance. This limitation can be solved through serial and parallel connections, as shown in FIGS. 4A and 4B. In FIG. 4A, the first, second, third, and fourth microfluidic elements 21, 22, 23, 24, the first and second deformable chambers 25, 26, and the vent hole 28 form a network with the first and second deformable chambers 25, 26 connected in series. In FIG. 4B, the first, second, third, and fourth micro fluid elements 31, 32, 33, 34, the first and second deformable chambers 35, 36, and the vent hole 38 form another network with the first and second deformable chambers 35, 36 connected in parallel. Both of these embodiments can drive the fluid therein by imposing pressure on both deformable chambers simultaneously, thereby increasing the driving distance. In practice, multiple deformable chambers can be provided to achieve a greater driving distance.

Figure 5:
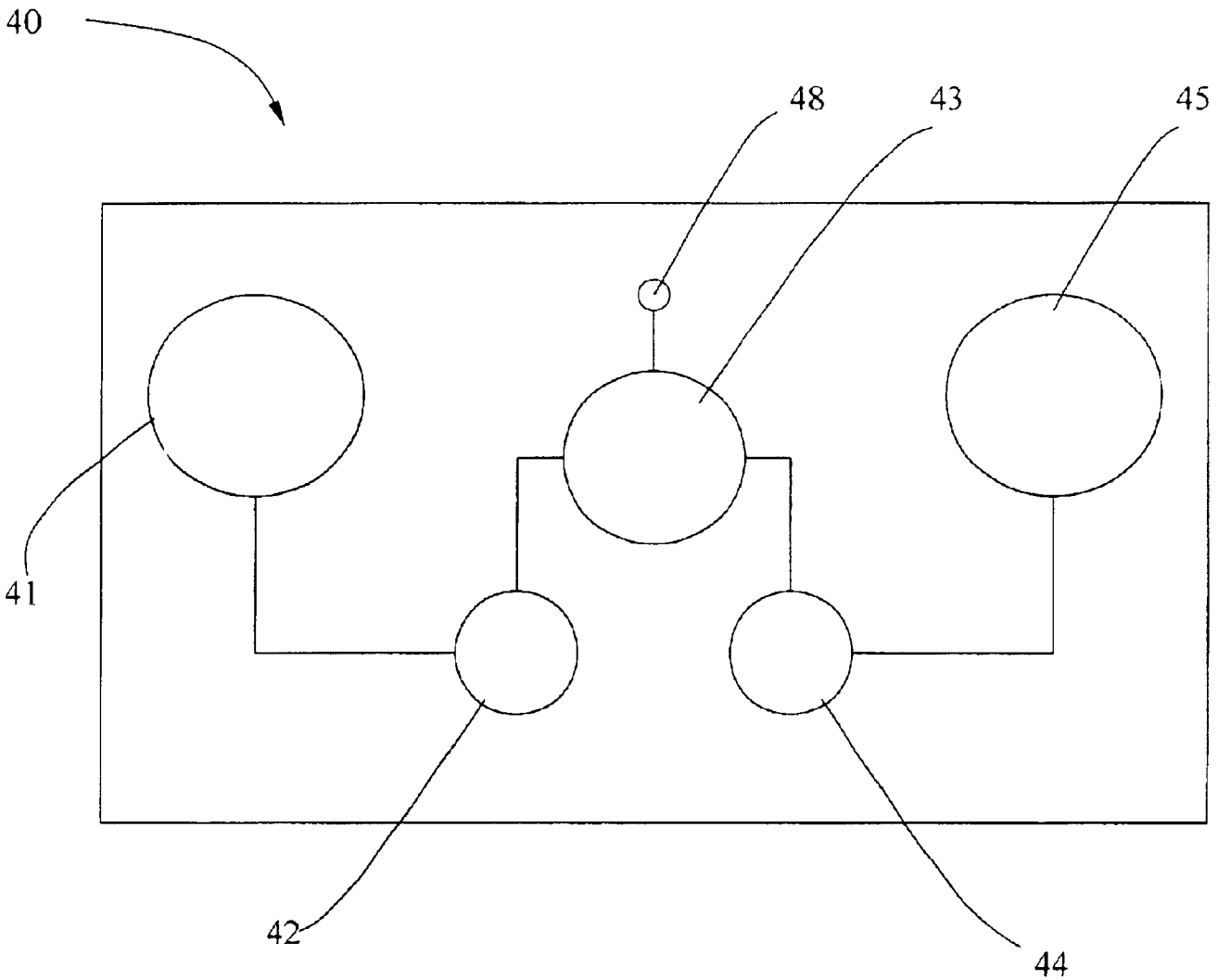
FIG. 5 is a schematic view of two sets of independent deformable chambers.

FIG. 5 is a schematic view of two sets of independent deformable chambers. They are comprised of two sets of independent microfluidic networks, respectively. The first microfluidic network contains a first deformable chamber 41, a first microfluidic element 42, a second microfluidic element 43 and a vent hole 48. The second microfluidic network contains a second deformable chamber 45, a third microfluidic element 44, the second microfluidic element 43 and the vent hole 48. Through these two sets of independent microfluidic networks, it is possible to fill two different reaction agents into the two networks, respectively, and drive them independently. Finally, the two different reaction agents may be mixed together at the second microfluidic element 43.

From the embodiment shown in FIG. 5, the invention further proposes the design of providing multiple sets of independent microfluidic networks on a single chip. Each microfluidic network can be filled with one type of agent, and all of them get mixed together at the same microfluidic element. Therefore, the invention can achieve another objective of mixing the agents. In this embodiment, the driving method is not different from the previous ones.

The invention is experimentally verified and produces the following results. Take a 100 mm long and 50 mm wide PMMA and use a milling machine to make a deformable chamber with a diameter of 10 mm and a depth of 1 mm. Drill a micro channel with the dimension 82.5 mm×1 mm×1 mm. The deformable chamber and the micro channel are connected by a 2 mm×0.5 mm×1 mm micro channel and packed using the AMC D291 polyester film. After the packaging, the deformable chamber is filled with red ink, which also fills the 0.5 mm micro channel and a small portion of the 1 mm wide micro channel. The pressure-imposing part is a micrometer caliper with a diameter of 6 mm. When the spiral micro ruler touches the thin film surface, no pressure is imposed yet. At this moment, the micrometer caliper stops at the 18.78 mm reading. Please refer to Table 1 for experimental data.

TABLE 1

| | Readings on the micrometer caliper (mm) | Liquid length in the micro channel (mm) | Theory calculation | Micro fluid displacement |
|---|---|---|---|---|
| 1 | 18.78 | 5 | 0.00 | 0 |
| 2 | 18.5 | 17.5 | 14.37 | 12.5 |
| 3 | 18.3 | 27.5 | 24.63 | 22.5 |
| 4 | 18.4 | 22.5 | 19.50 | 17.5 |
| 5 | 18.45 | 20 | 16.93 | 15 |
| 6 | 18.5 | 17.5 | 14.37 | 12.5 |
| 7 | 18.6 | 12 | 9.24 | 7 |
| 8 | 18.78 | 5.8 | 0.00 | 0.8 |
| 9 | 18.7 | 7 | 4.10 | 2 |
| 10 | 18.6 | 12.3 | 9.24 | 7.3 |
| 11 | 18.5 | 17 | 14.37 | 12 |
| 12 | 18.45 | 20 | 16.93 | 15 |
| 13 | 18.4 | 22.5 | 19.50 | 17.5 |
| 14 | 18.3 | 27 | 24.63 | 22 |
| 15 | 18.2 | 32.4 | 29.76 | 27.4 |
| 16 | 18.1 | 37.1 | 34.89 | 32.1 |
| 17 | 18 | 42 | 40.02 | 37 |
| 18 | 18.1 | 37.3 | 34.89 | 32.3 |
| 19 | 18.2 | 32.7 | 29.76 | 27.7 |
| 20 | 18.3 | 27.4 | 24.63 | 22.4 |
| 21 | 18.4 | 23 | 19.50 | 18 |
| 22 | 18.45 | 20.8 | 16.93 | 15.8 |
| 23 | 18.5 | 17.8 | 14.37 | 12.8 |
| 24 | 18.6 | 12.2 | 9.24 | 7.2 |
| 25 | 18.7 | 7.5 | 4.10 | 2.5 |
| 26 | 18.78 | 6.5 | 0.00 | 1.5 |

Figure 6:
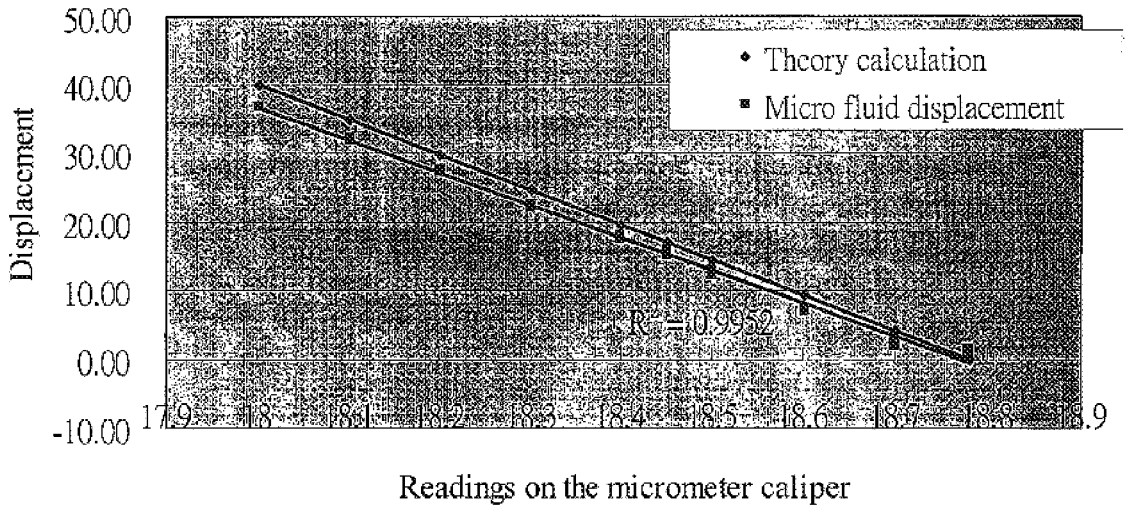
FIG. 6 shows the experimental results of the invention.

From Table 1, we obtain the curves in FIG. 6. From FIG. 6, one finds that the invention has a linear driving relationship. That means such a driving method is easy to control and can be predicted through simple calculations. One can also see in the drawing the stability and reciprocating motion of the invention. Good agreement between the experimental values and the theory values supports the above observation. The difference between the experimental values and the theory values may result from the machining errors and experimental errors in the experiments.

In summary, the invention utilizes different extents of deformation on deformable chambers to achieve different micro fluid displacements under a partially closed system. Since it is easy in practical controls, the invention can satisfy the needs for short-distance, reciprocal and different displacements.

EFFECTS OF THE INVENTION

The disclosed microfluidic driving method using deformable chambers has the following advantages:

1. The actuator and the reaction agent are separate; therefore, the invention does not have pollution problems and the system can be repeatedly used.
2. The system can be readily prepared with a low cost. Therefore, the invention is disposable.
3. The chip and the external system do not need any pipeline connections; therefore, it is easy to assemble and dissemble.
4. The elasticity of the thin film helps in achieving the reciprocating motion of micro fluid.
5. The imposed pressure and the fluid motion have a linear relation. Therefore, the invention can achieve precision positioning of the micro fluid.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A fluid driving method for a partially closed microfluidic chip, which comprises the steps of:

providing a partially closed microfluidic chip, which has a substrate, a thin film, a channel consisting of at least one deformable chamber, at least one microfluidic element, and a vent hole, the thin film attached to the substrate and above the deformable chamber, and the channel being filled with a fluid;

imposing a positive pressure on the thin film above the deformable chambers in accordance with the pushing distance of the fluid to cause the fluid to flow and a pressure released through the vent hole; and releasing the positive pressure for the fluid to flow back and the pressure to refill from the vent hole.

2. The method of claim 1, wherein the positive pressure is provided by an actuator.

3. The method of claim 1, wherein the positive pressure is provided by a device selected from the group consisting of linear actuators, eccentric wheels and cams that make curved motions, and air-pressure and thermodynamic drives.

4. A partially closed micro fluid chip, which comprises:

a fluid network;

a substrate with at least one microfluidic element, at least one deformable chamber, a vent hole and a plurality of micro channels, the plurality of micro channels connecting the micro fluid element(s), the deformable chamber(s), and the vent hole to form a network for the fluid to flow therein; and an elastic, deformable thin film, attached to the substrate and above the deformable chamber;

wherein when pressing on the thin film, a fluid inside the deformable chamber is pushed to flow and a pressure released through the vent hole, and when releasing the thin film, the pressure refills from the vent hole to cause the fluid to flow back and the elastic restoration of the thin film.

5. The partially closed microfluidic chip of claim 4, wherein the thin film on top of the deformable chambers is imposed with a positive pressure to generate deformation, pushing the fluid to flow, and the fluid flows back after the positive pressure is released.

6. The partially closed microfluidic chip of claim 5, wherein the positive pressure is provided by an actuator.

7. The partially closed microfluidic chip of claim 4, wherein the positive pressure is provided by a device selected from the group consisting of linear actuators, eccentric wheels and cams that make curved motions, and pneumatic and thermodynamic drives.

8. The partially closed microfluidic chip of claim 4 further comprising a driving fluid filled inside the deformable chambers for driving the fluid inside the network into motion when the deformable chambers are deformed.

9. The partially closed micro fluid chip of claim 8, wherein the driving fluid is an oil.

10. The partially closed microfluidic chip of claim 8, wherein the driving fluid fills the deformable chambers.

11. The partially closed microfluidic chip of claim 4, wherein the deformable chambers are installed at the end of the network opposite to the vent hole.

12. The partially closed microfluidic chip of claim 4, wherein the deformable chambers are installed at the end of the network opposite to the vent hole and connected by the plurality of micro channels in series.

13. The partially closed micro fluid chip of claim 4, wherein the deformable chambers are installed at the end of the network opposite to the vent hole and connected by the plurality of micro channels in parallel.

14. The partially closed microfluidic chip of claim 4, wherein the thin film is made of a material selected from the group consisting of tapes and polyester films.

15. The partially closed microfluidic chip of claim 4, wherein the substrate is made of a silicon-based material selected from the group consisting of glass, quartz, silicon, and polysilicon, or polymeric materials, i.e. plastics, such as polymethyl-methacrylate (PMMA), polycarbonate, polytetrafluoroethylene (TEFLON™), polyvinyl-chloride (PVC), polydimethylsiloxane (PDMS), polysulfone, and SU-8.

16. The partially closed microfluidic chip of claim 4, wherein the formation of the microfluidic elements, the vent hole and the deformable chambers on the substrate is done by a method selected from the group consisting of photolithography, MEMS, laser ablation, air abrasion, injection molding, embossing or stamping, and polymerizing the polymeric precursor material in the mold.

17. A partially closed micro fluid chip, which comprises:

two fluid networks;

a substrate with at least two microfluidic channels, each of which consisting of at least one microfluidic element, at least one deformable chamber, a vent hole and a plurality of micro channels, the plurality of micro channels connecting the microfluidic element(s), the deformable chamber(s), and the vent hole to form an independent network for a fluid to flow therein and the fluids mixing at a shared microfluidic element; and an elastic, deformable thin film, attached to the substrate and above the deformable chamber;

wherein when pressing on the thin film, a fluid inside the deformable chamber is pushed to flow and a pressure released through the vent hole, and when releasing the thin film, the pressure refills from the vent hole to cause the fluid to flow back and the elastic restoration of the thin film.

18. The partially closed microfluidic chip of claim 17, wherein the thin film on top of the deformable chambers of each of the microfluidic channels is imposed with a positive pressure to generate deformation, pushing the fluid to flow, and the fluid flows back after the positive pressure is released.

19. The partially closed microfluidic chip of claim 18, wherein the positive pressure is provided by an actuator.

20. The partially closed microfluidic chip of claim 17, wherein the positive pressure is provided by a device selected from the group consisting of linear actuators, eccentric wheels and cams that make curved motions, and pneumatic and thermodynamic drives.

21. The partially closed microfluidic chip of claim 17 further comprising a driving fluid filled inside the deformable chambers of each of the microfluidic channel for driving the fluid inside the channel into motion when the deformable chambers are deformed.

22. The partially closed microfluidic chip of claim 21, wherein the driving fluid is an oil.

23. The partially closed microfluidic chip of claim 21, wherein the driving fluid fills the deformable chambers.

24. The partially closed microfluidic chip of claim 21, wherein the microfluidic channels are partially filled with the driving fluid.

25. The partially closed microfluidic chip of claim 17, wherein the deformable chambers of each of the microfluidic channels are installed at the end of the network opposite to the vent hole.

26. The partially closed microfluidic chip of claim 17, wherein the deformable chambers of each of the microfluidic channels are installed at the end of the channel opposite to the vent hole and connected by the plurality of micro channels in series.

27. The partially closed microfluidic chip of claim 17, wherein the deformable chambers of each of the microfluidic channels are installed at the end of the channel opposite to the vent hole and connected by the plurality of micro channels in parallel.

28. The partially closed microfluidic chip of claim 17, wherein the thin film is made of a material selected from the group consisting of tapes and polyester thin films.

29. The partially closed microfluidic chip of claim 17, wherein the substrate is made of a silicon-based material selected from the group consisting of glass, quartz, silicon, and polysilicon, or polymeric materials, i.e. plastics, such as polymethyl-methacrylate (PMMA), polycarbonate, polytetrafluoroethylene (TEFLON™), polyvinyl-chloride (PVC), polydimethylsiloxane (PDMS), polysulfone, and SU-8.

30. The partially closed microfluidic chip of claim 17, wherein the formation of the microfluidic elements, the vent hole and the deformable chambers on the substrate is done by a method selected from the group consisting of photolithography, MEMS, laser ablation, air abrasion, injection molding, embossing or stamping, and polymerizing the polymeric precursor material in the mold.

* * * * *